United States Patent [19]

Thompson et al.

[11] Patent Number: 4,491,200

[45] Date of Patent: Jan. 1, 1985

[54] LOCKING MECHANISM FOR AN ELEVATOR CAR DOOR

[75] Inventors: William I. Thompson, Brooklyn, Mich.; Mark F. Welter, Waterville; Dean L. Jodry, Sylvania, both of Ohio

[73] Assignee: Schlindler Haughton Elevator Corp., Toledo, Ohio

[21] Appl. No.: 407,300

[22] Filed: Aug. 11, 1982

[51] Int. Cl.[3] ..... B66B 13/00

[52] U.S. Cl. ..... 187/61; 187/57; 49/116

[58] Field of Search ..... 187/52 R, 51, 57, 52 LC, 187/61, 31, 32; 49/116, 118, 120

[56] References Cited

U.S. PATENT DOCUMENTS 3,605,952 9/1971 Lusti ..... 187/52 LC 4,364,454 12/1982 Glaser et al. ..... 187/57

*Primary Examiner*—H. Grant Skaggs

*Assistant Examiner*—Kenneth Noland

*Attorney, Agent, or Firm*—Fraser, Barker, Purdue & Clemens

[57] ABSTRACT

An apparatus for preventing the car door section of an elevator car from being opened when the elevator car is not located at an authorized landing zone in the elevator shaft. A car door locking device includes a locking mechanism connected to and movable with the car door section. The locking mechanism has a first member, a second member, and apparatus for connecting the second member for limited guided movement with respect to the first member between a locked position and an unlocked position. A spring is provided for normally urging the second member toward the locked position with respect to the first member. A first stop is attached to and movable with the second member. A second stop, fixed in position with respect to the car door section, is provided for selectively engaging the movable stop. Apparatus is provided for moving the second member to the unlocked position only when the elevator car is located in an authorized landing zone in the elevator shaft, whereby the movable stop engages the fixed stop to prevent the car door section from being opened only when the second member is in the locked position and the movable stop does not engage the fixed stop when the second member is in the unlocked position.

21 Claims, 6 Drawing Figures

LOCKING MECHANISM FOR AN ELEVATOR CAR DOOR

BACKGROUND OF THE INVENTION

1. Field of the Invention

The present invention relates in general to safety mechanisms for elevator car doors and in particular to a locking mechanism for preventing the opening of an elevator car door when the car is situated between floor landings in an elevator shaft.

Elevator cars are customarily provided with horizontally movable car doors consisting of two sections. The sections either part in the center or slide together to one side to allow entrance into the car. For most elevators, it is required that the car doors be locked by mechanical or electrical means when the car is not positioned within a predetermined landing zone such that the door cannot be manually opened from within the car. For example, the ANSI/ASME Code Rule 110.6 requires that passenger elevator hoistway doors be so arranged that they may be opened by hand from within the elevator car only when the car is within the landing zone, except at an entrance which has been locked out of service.

Generally, the sections of the elevator car door cooperate with respective floor landing door sections when the car is within the landing zone to disengage a locking mechanism, thereby allowing the doors to open. In the usual instance, an interlocking means is provided on the opposing faces of the car and landing doors to release the locking mechanism when the car is properly positioned.

2. Description of the Prior Art

U.S. Pat. No. 1,838,524 to Brown discloses a safety device for an elevator system employing horizontally-sliding car and hatchway floor doors. The safety device includes a channel strip mounted on the car door and a plurality of rail sections mounted on the hoistway doors and the shaft walls. When the car floor and the landing floor are in substantial alignment, the channel strip engages the rail section on the hoistway door for simultaneous opening movement. As the car moves away from the floor, the channel strip engages a rail section on the shaft wall, thereby preventing opening of the car door.

U.S. Pat. No. 2,499,979 to Smith discloses an operating mechanism for the landing doors of elevators. A cam plate must be engaged with a roller on a lock bar to unlock the door. Such unlocking can occur only if the car is located in front of the landing in the proper position for unloading or loading when the operator starts the operation of the door mechanism.

U.S. Pat. No. 3,991,858 to Westerlund discloses a locking device for a holding door on an elevator shaft. The locking device includes a barrier member that is interconnected to a locking arm. The locking arm is alternately engageable and disengageable with a stop means such that the barrier member can be moved out of the way of a holding door when the elevator is adjacent to the holding door.

SUMMARY OF THE INVENTION

The present invention relates to a means for preventing the car door section of an elevator car from being opened when the elevator car is not located at an authorized landing zone in the elevator shaft. The car door locking means includes a locking mechanism means connected to and movable with the car door section.

The locking mechanism means has a first member, a second member, and means for connecting the second member for limited guided movement with respect to the first member between a locked position and an unlocked position. Spring means normally urge the second member toward the locked position with respect to the first member. A first stop means is attached to and movable with the second member. A second stop means, fixed in position with respect to the car door section, is provided for selectively engaging the movable stop means.

Means are provided for moving the second member to the unlocked position when the elevator car is located at an authorized landing zone in the elevator shaft. When the second member is in the unlocked position, the movable stop means does not engage the fixed stop means and the car door section can be opened automatically or by hand. The movable stop means engages the fixed stop means to prevent the car door section from being opened only when the second member is in the locked position.

It is an object of the present invention to provide an improved locking mechanism for an elevator car door.

It is another object of the present invention to provide a safety operating mechanism for an elevator car door which is simple and inexpensive in construction.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
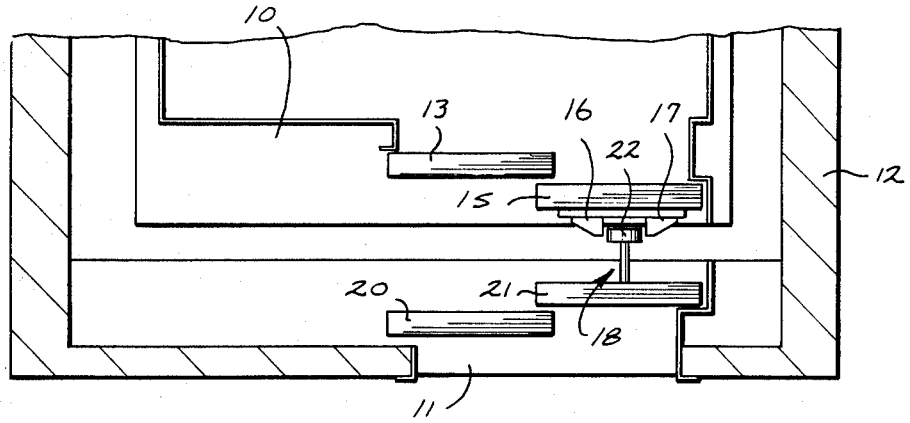
FIG. 1 is a top plan view, partially in cross section, of a portion of an elevator car positioned at a floor landing of an elevator shaft.

Referring now to the drawings, there is illustrated in FIG. 1 an overhead view of a portion of an elevator car 10 positioned at a floor landing 11 of an elevator shaft 12. Conventional means (not shown) are provided to guide and move the car 10 vertically throughout the shaft 12. The car 10 includes a pair of car door sections 13 and 15 which are horizontally slidable to one side to permit entry into the car 10. Although the present invention will be described in terms of the car door sections 13 and 15 sliding to the same side of the elevator car 10, it will be appreciated that the present invention can be utilized on center parting or any other type of elevator door. The one car door section 15 is provided with a pair of movable clutch vanes 16 and 17. The vanes 16 and 17 cooperate with an interlock roller assembly, indicated generally at 18, mounted on one of a pair of horizontally slidable floor landing door sections 20 and 21.

The interlock roller assembly 18 is conventional in the art and consists of one or more rollers 22 (only one of two is illustrated in FIG. 1) mounted on a pivotable interlock arm (not shown). When the elevator car 10 is not located at the floor landing 11, the interlock rollers 22 do not engage the inner edges of the clutch vanes 16 and 17. A spring means (not shown) causes the interlock arm to be spring-biased to a first position. In this first position, the floor landing door sections 20 and 21 are mechanically locked to prevent them from being opened. When the elevator car 10 is vertically moved adjacent the floor landing 11, the interlock rollers 22 are engaged between the clutch vanes 16 and 17 such that the interlock arm is pivoted to a second position, wherein the floor landing door sections 20 and 21 are released. Hence, the interlock roller assembly 18 provides a means for preventing the floor landing door sections 20 and 21 from being opened when the elevator car 10 is not located adjacent an authorized floor landing 11. It will be appreciated that the size of the landing zone at each floor landing 11 can be varied by increasing or decreasing the vertical length of the clutch vanes 16 and 17.

Figure 2:
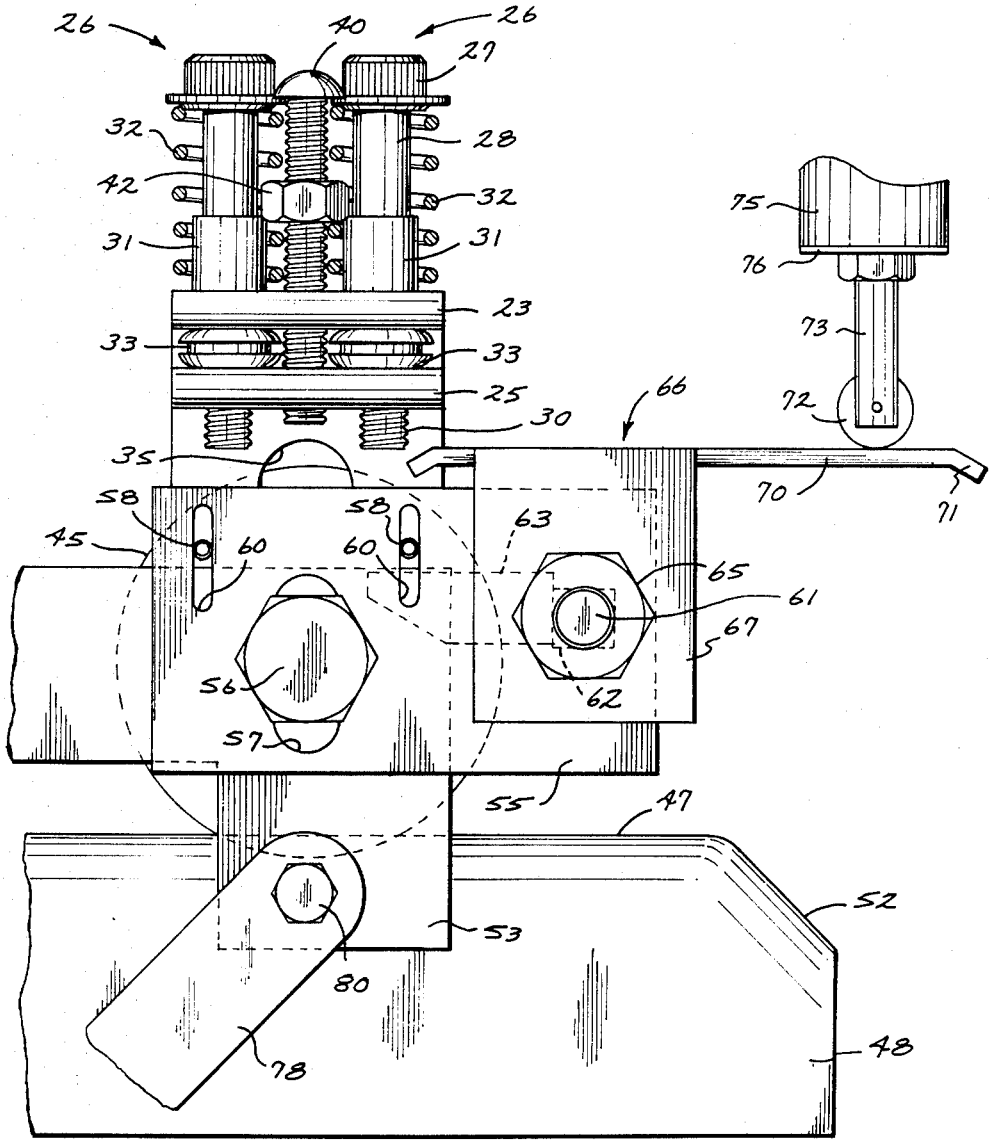
FIG. 2 is a front elevational view of a locking mechanism for an elevator car door in accordance with the present invention.
Figure 3:
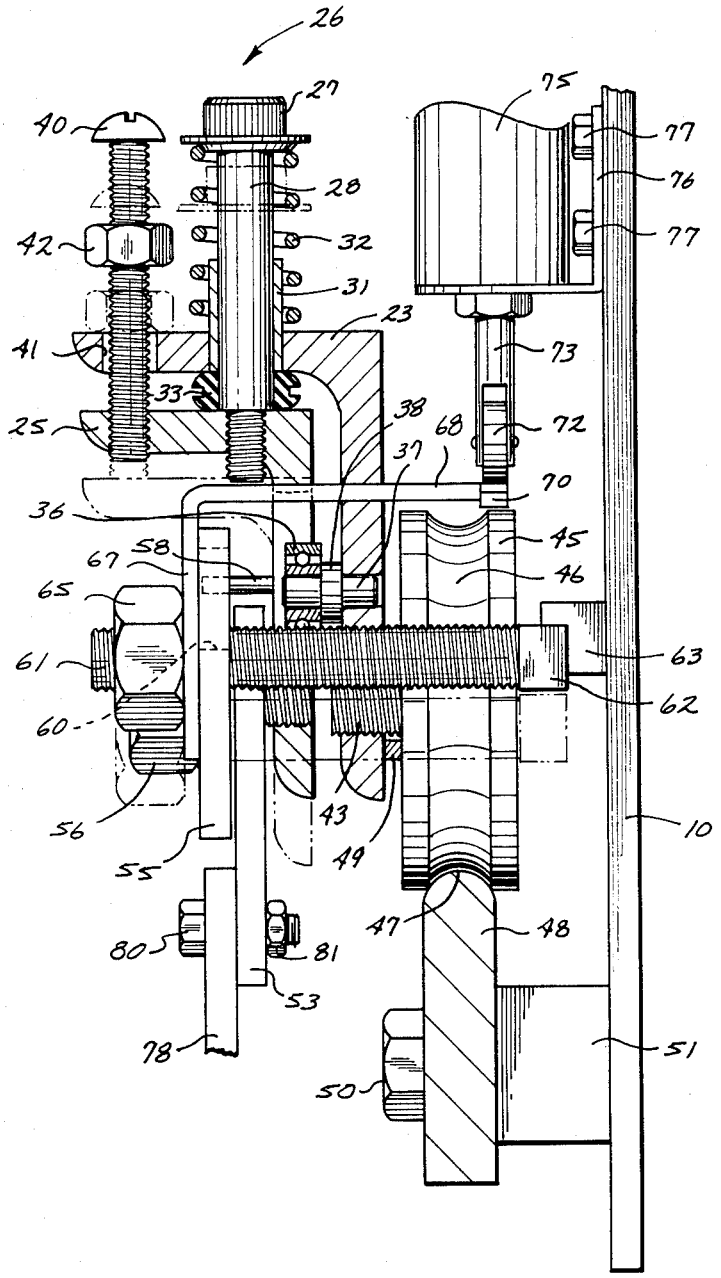
FIG. 3 is a side elevational view of the elevator car door locking mechanism of FIG. 2 with the locking members shown in cross section.

Referring now to FIGS. 2 and 3, there is illustrated an elevator car door locking mechanism in accordance with the present invention. As will be described below, the locking mechanism of the present invention can be utilized in conjunction with the above-described floor landing door locking means. The present invention provides a means for preventing the elevator car door sections 13 and 15 from being opened when the elevator car 10 is not located within the landing zone, apart from the means for preventing the floor landing door sections 20 and 21 from being opened.

The car door locking mechanism includes a pair of inverted L-shaped locking members 23 and 25 which are shown in cross section. The locking members 23 and 25 are oriented in the same direction and vertically stacked with the foot of member 23 horizontally extending above and parallel to the foot of member 25 and the legs of the members vertically extending in parallel relationship. The locking member 25 is maintained in sliding alignment below the locking member 23 by a pair of socket head shoulder mounting bolts 26. Each of the bolts 26 is provided with an enlarged head portion 27 at one end, a central shaft portion 28, and a threaded portion 30 at the other end. The shaft portion 28 of each bolt 26 is slidably maintained in a journal bearing 31 secured in an aperture (FIG. 3) formed in the foot of the member 23. The threaded end portion 30 of each bolt 26 is threadably secured to the foot portion of the member 25. A spring 32 is concentrically disposed about each shaft portion 28 and journal bearing 31 between the enlarged head portion 27 of each bolt 26 and the upper surface of the foot of the member 23. The springs 32 urge the locking member 25 upwardly towards the locking member 23 to a locked position, as shown in FIGS. 2 and 3. However, a sufficient downward force applied to the member 25 can overcome the urging of the springs 32 to move the member 25 downwardly away from the outer member 23 to an unlocked position, as shown by the phantom lines in FIG. 3. If desired, an elastomeric washer 33 can be concentrically disposed about the portion of the bolt 26 extending between the lower surface of the member 23 and the upper surface of the member 25 to reduce noise.

The leg portion of the member 25 is provided with an oval aperture 35. The aperture 35 receives a roller bearing 36 which is rotatably mounted upon a horizontally extending post 37 secured to the leg of the member 23. A spacer element 38 may be provided on the post 37 to properly position the roller bearing 36. The width and curved end portions of the oval aperture 35 are preferably sized to correspond to the diameter and radius, respectively, of the roller bearing 36 to prevent the member 25 from being twisted out of parallel alignment with the member 23.

In operation, as the locking member 25 is moved upwardly and downwardly with respect to the locking member 23, the oval aperture 35 is vertically moved about the roller bearing 36. Hence, the length of the oval aperture 35 provides a means for limiting the length of the path of vertical movement of the member 25. A threaded bolt 40 can also be utilized in conjunction with the above-described aperture 35 and roller bearing 36 to limit the amount of movement of the member 25 with respect to the member 23. The bolt 40 extends through a circular aperture 41 formed in the foot of the member 23 into threaded engagement with the foot of the member 25. A nut 42 is threaded onto the bolt 40 such that it is disposed above the upper surface of the foot of the member 23. By rotating the nut 42, the distance separating the nut 42 from the upper surface of the foot of the member 23 can be adjusted. When the member 25 is moved downwardly with respect to the member 23, the bolt 40 will be pulled downwardly through the aperture 41 until the nut 42 engages the upper surface of the foot of the member 23 thereby limiting the downward travel of the member 25.

The leg of the member 23 is secured by a threaded bolt 43 to a rotatable guide roller 45. The head of the bolt 43 can be recessed within the body of the guide roller 45. The guide roller 45 includes a concave circumferential surface portion 46 which cooperates with and rolls along a correspondingly-shaped convex surface upper edge portion 47 of a door track 48. A spacer element 49 can be disposed about the threaded bolt 43 between the member 23 and the guide roller 45 to maintain the guide roller 45 in proper horizontal alignment with the door track 48. The door track 48 is connected by a bolt 50 and a spacer element 51 or other appropriate means to an upstanding portion of the elevator car 10 and is immovable with respect thereto. The door track 48 includes a beveled end portion 52 which, as will be explained below, permits the guide roller 45 to roll downwardly thereupon.

The member 25 is connected to a roller arm 53 and a lock bolt mounting plate 55 by a threaded bolt 56. The bolt 56 extends through an oval aperture 57 formed in the lock bolt mounting plate 55 and a circular aperture (not shown) formed in the roller arm 53 into threaded engagement with the leg portion of the member 25. A pair of aligning pins 58 extend outwardly from the leg portion of the member 25 into respective oval apertures 60 formed in the lock bolt mounting plate 55. The oval apertures 57 and 60 are appropriately sized with respect to the threaded bolt 56 and the aligning pins 58, respectively, such that the lock bolt mounting plate 55 can be adjusted upwardly or downwardly when the bolt 56 is loosened, while sideways movement of the plate 55 with respect to the member 25 is prevented. When the bolt 56 is tightened, the member 25, the roller arm 53, and the lock bolt mounting plate 55 are frictionally secured together.

One end of a threaded lock bolt 61 is retained in a cooperating threaded aperture (not shown) formed in the lock bolt mounting plate 55. The lock bolt 61 includes a flat movable stop portion 62 disposed at an opposite end thereof. As will be explained in greater detail below, the locking mechanism of the present invention selectively positions the movable stop 62 to engage a fixed stop 63 secured to the upstanding portion of the elevator car 10 to prevent the elevator car door sections 13 and 15 from being opened when the car 10 is not positioned within a predetermined landing zone.

A lock nut 65 is threaded onto the one end of the lock bolt 61. The lock nut 65 is utilized to frictionally secure a switch cam assembly 66 to the lock bolt mounting plate 55. The switch cam assembly 66 includes a vertically extending cam plate 67 which is engaged between the lock nut 65 and the lock bolt mounting plate 55, a horizontally extending cam plate extension member 68, and a relatively narrow outwardly extending cam arm 70. The cam arm 70 includes a downwardly-bent end portion 71 for cooperating with a switch roller 72. The switch roller 72 is rotatably held by a plunger portion 73 of a microswitch 75. The microswitch 75 is secured to the upstanding portion of the elevator car 10 by a switch mounting plate 76 and a pair of threaded bolts 77.

The lower end of roller arm 53 is pivotally connected to one end of a clutch arm 78 by a threaded bolt 80 and nut 81. As will be explained in greater detail below, the clutch arm 78 extends downwardly into cooperation with the clutch vanes 16 and 17 to operate the floor landing door sections 20 and 21 when the elevator car 10 is positioned at a floor landing 11.

Figure 4:
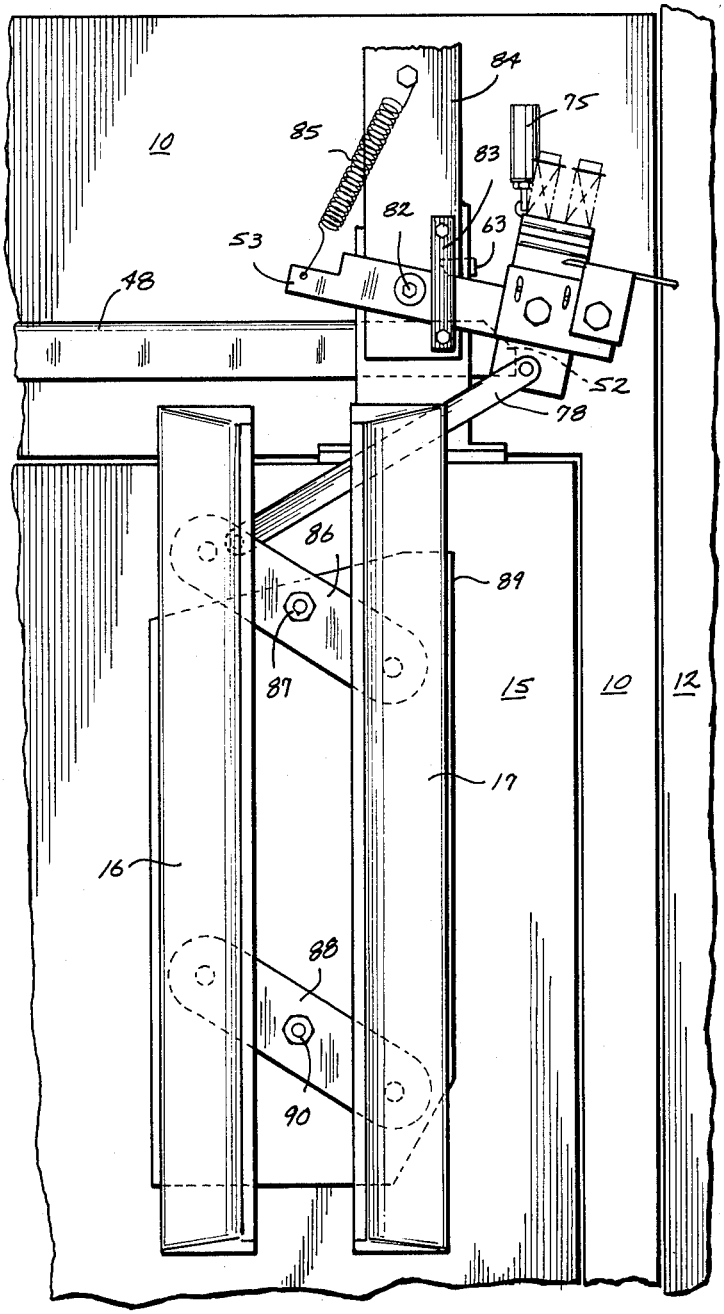
FIGS. 4, 5, and 6 are front elevational views of a portion of an elevator car door illustrating the locking mechanism of FIG. 2 in different operating modes.
Figure 5:
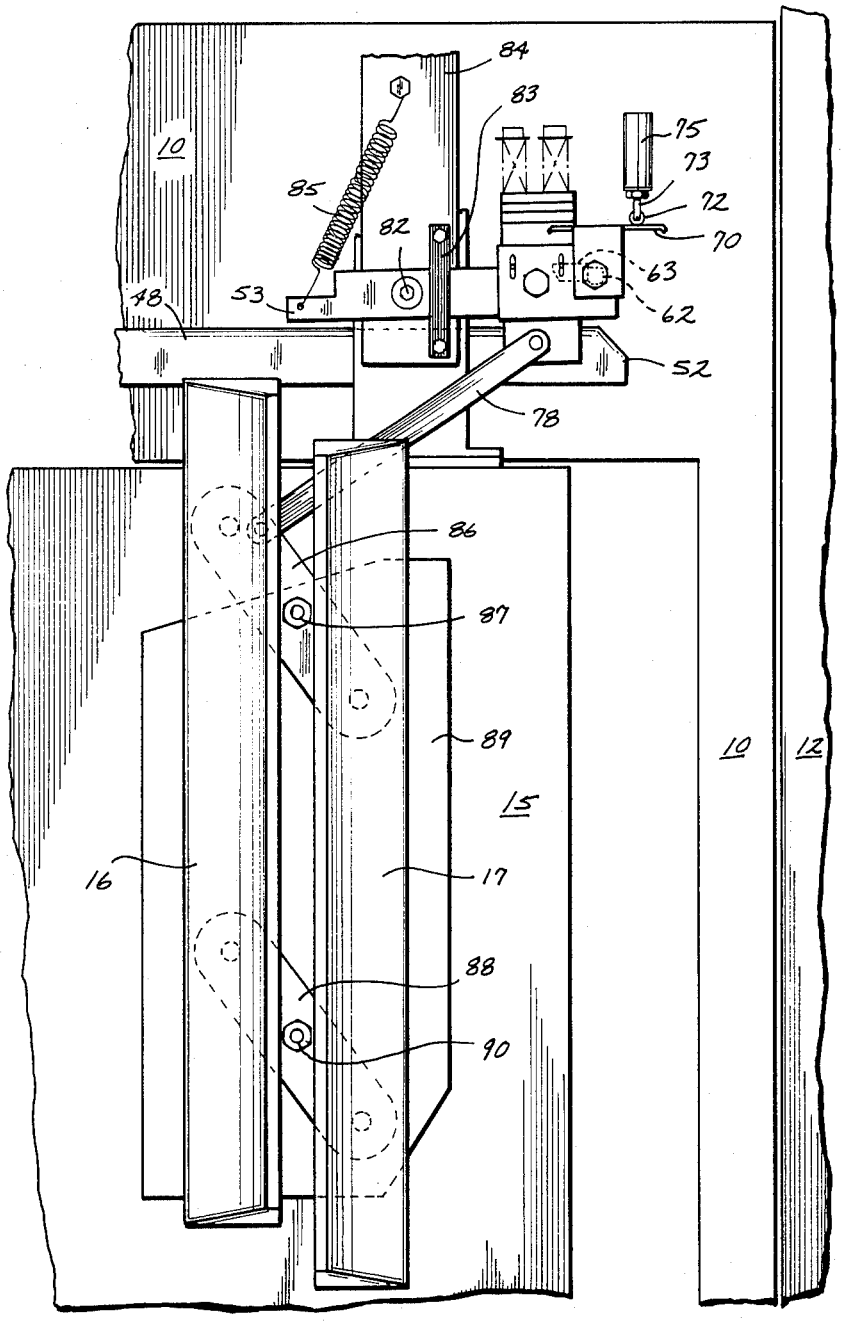
Figure 6:
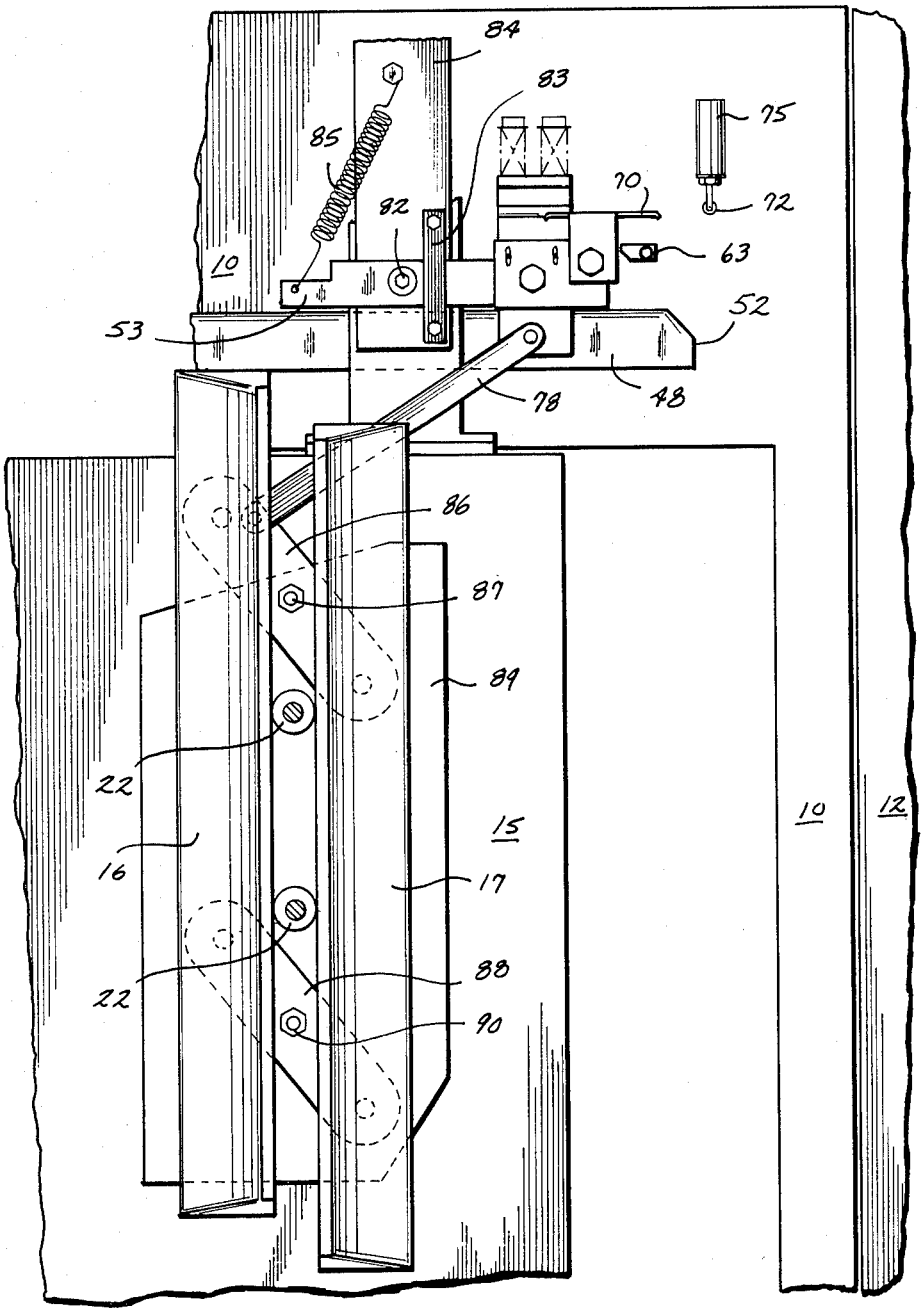

Referring now to FIGS. 4, 5, and 6, it can be see that the roller arm 53 carrying the locking means is pivotally mounted on an upstanding portion 84 of the elevator car door section 15 by a threaded bolt 82. A retaining plate 83 may be bolted to and spaced from the upstanding portion 84. The roller arm 53 extends between the portion 84 and the plate 83 to prevent lateral movement of the arm 53 while permitting limited pivoting action about the bolt 82. Such pivoting movement allows the locking mechanism, supported on the guide roller 45 (not shown), to roll downwardly onto the beveled end portion 52 of the door track 48. To insure that the locking mechanism moves downwardly when the guide roller 45 reaches the beveled end portion 52 of the door track 48, a spring 85 is connected between the other end of the roller arm 53 and the upstanding portion 84 of the elevator car door section 15 to rotate the roller arm 53 about the bolt 82.

The clutch arm 78 extends downwardly from the roller arm 53 into a pivotable connection with an upper pivot arm 86. The upper pivot arm 86 is pivotally connected by a bolt 87 to a mounting plate 89 secured to the car door section 15. Similarly, a lower pivot arm 88 is pivotally connected by a bolt 90 to the mounting plate 89. The clutch vanes 16 and 17 are each pivotally mounted at their upper and lower ends to the upper and lower pivot arms 86 and 88, respectively, such that the clutch vanes 16 and 17 are maintained in parallel alignment as the upper and lower pivot arms 86 and 87 are moved.

FIG. 4 illustrates the elevator car door section 15 in a closed position adjacent the side of the elevator car 10. In this position, the elevator car 10 is free to move vertically between floor landings 11. As the car door section 15 is closed, the guide roller 45 is rolled across the door track 48 and downwardly onto the beveled end portion 52. When the guide roller 45 rolls down the beveled end portion 52 of the door track 48, the downward pivoting movement of the roller arm 53 causes a force to be exerted by the clutch arm 78 against the upper end of the upper pivot arm 86. Such force causes the upper and lower pivot arms 86 and 88 to pivot about their respective mounting bolts 87 and 90, thereby spreading the clutch vanes 16 and 17 to a position of maximum separation therebetween. In this position, the distance separating the clutch vanes 16 and 17 is greater than the diameter of the interlock rollers 22 of the above-described interlock assembly 18. Thus, the clutch vanes 16 and 17 do not engage the interlock rollers 22 and the elevator car 10 is free to move vertically through the elevator shaft 12.

FIG. 5 illustrates the elevator car door section 15 in a partially opened position when the elevator car 10 is located between floor landings 11 in the elevator shaft 12. As the car door section 15 is pulled sideways in an attempt to enter or exit the elevator car 10 at an unauthorized location, the guide roller 45 rolls up the beveled end portion 52 onto the main portion of the door track 48. Such upward movement of the guide roller 45 causes the roller arm 53, and the locking mechanism carried thereon, to rise upwardly. Hence, an upward force is applied by the clutch arm 78 to the one end of the upper pivot arm 86, causing the clutch vanes 16 and 17 to be moved inwardly toward each other. Since the elevator car 10 is located between floor landings 11, the car door section 15 is not positioned adjacent a floor landing door 21, as illustrated in FIG. 1. Accordingly, the interlock rollers 22 of the interlock roller assembly 18 are not disposed between the clutch vanes 16 and 17. The upward movement of the roller arm 53, therefore, causes the clutch vanes 16 and 17 to be moved inwardly to a position of minimum separation therebetween. In this position, the distance separating the clutch vanes 16 and 17 is less than the diameter of the interlock rollers 22.

As soon as the guide roller 45 has moved upwardly off the beveled end portion 52 of the door track, the cam arm 70 engages the microswitch roller 72, causing the plunger 73 to be moved longitudinally upwardly to actuate the microswitch 75. The microswitch 75 is connected in an electrical circuit with the elevator car door motor (not shown) such that actuation of the microswitch 75 as described above opens the electrical circuit and disables the car door motor. Thus, any attempt to open the elevator car door section 15 at an unauthorized location will cause the elevator car door motor to be disabled automatically.

As mentioned above, the clutch vanes 16 and 17 are free to move toward the position of minimum separation because the interlock rollers 22 are not disposed therebetween. Because of this, little downward pressure is exerted against the roller arm 53 and, hence, the locking member 25. Accordingly, the member 25 remains in the upward locked position with respect to the locking member 23 because of the urging of the springs 32. Thus, the cam arm 70 remains in contact with the roller 72 of the microswitch 75. Also, as the car door section 15 is continued to be moved sideways, the movable stop 62 carried by the lock bolt mounting plate 55 moves into blocking engagement with the fixed stop 63 attached to the upstanding portion of the elevator car 10, thereby preventing any further sideways movement. The stop 63 can be located at a position which permits only a minimum movement of the car door section, typically about four inches. Hence, the car door section 15 is prevented from being opened when the elevator car 10 is at an unauthorized location in the elevator shaft 12.

FIG. 6 illustrates the elevator car door section in a partially opened position when the elevator car 10 is located at an authorized floor landing 11 in the elevator shaft 12. As described above, the opening of the car door section 15 causes the guide roller 45 to roll upwardly off the beveled end portion 52 onto the main portion of the door track 48. However, when the car door section 15 is positioned adjacent a floor landing door 21, the interlock rollers 22 are disposed between the clutch vanes 16 and 17, preventing them from being moved inwardly to the above-described position of minimum separation. Rather, the interlock rollers 22 maintain the clutch vanes 16 and 17 at a position of intermediate separation therebetween approximately equal to the diameter of the rollers. Since the clutch vanes 16 and 17 are prevented from moving to the above-described position of minimum separation, a strong downward force is applied by the clutch arm 78 to the roller arm 53. Since the roller arm 53 is connected to the locking member 25 of the locking mechanism, which member 25 is vertically movable with respect to the member 23, it will be appreciated that the member 25, the clutch arm 53, the lock bolt mounting plate 55, the movable stop 62, and the switch cam assembly 66 all will be pulled downwardly to the unlocked positions indicated by the phantom lines of FIG. 3. Hence, the cam arm 70 will not engage the microswitch roller 72 and disable the elevator car door motor. Also, the movable stop 62 will be pulled downwardly such that it cannot move into engagement with the fixed stop 63 as the car door section 15 is pulled sideways. Rather, the movable stop 62 passes beneath the fixed stop 63. The elevator car door section 15 is thus free to be moved completely sideways to permit access to the interior of the elevator car 10. When the car door section 15 is closed, the locking mechanism and clutch assembly are returned to the positions illustrated in FIG. 4.

In the accordance with the provisions of the patent statutes, the principle and mode of operation of the present invention have been explained and illustrated in its preferred embodiment. However, it must be appreciated that the present invention can be practiced otherwise than specifically explained and illustrated without departing from its spirit or scope.

What is claimed is:

1. In an elevator car having a car door section movable between an opened position and a closed position, the elevator car being movable throughout an elevator shaft, means for preventing the car door section from being opened when the elevator car is not located at an authorized landing zone in the elevator shaft comprising:

locking mechanism means attached to and movable with the car door section, said locking mechanism means including a first member, a second member, and means for attaching said second member to said first member for limited guided movement of said second member between a first position and a second position;

means for urging said second member toward said first position;

first stop means attached to and movable with said second member;

second stop means attached to the car for selectively engaging said first stop means; and means for moving said second member to said second position when the elevator car is located at an authorized landing zone in the elevator shaft, whereby said first stop means engages said second stop means to prevent the car door section from being opened only when said second member is in said first position.

2. The invention of claim 1 wherein said first and second members are inverted L-shaped in cross-section, each of said first and second members having an upper foot portion and a depending leg portion.

3. The invention of claim 2 wherein said means for attaching said second member to said first member includes at least one mounting bolt, said mounting bolt being threadably secured to said foot portion of said second member and slidably held in a journal bearing means formed in said foot portion of said first member.

4. The invention of claim 3 wherein said means for urging said second member toward said first position includes spring means disposed between said foot portion of said first member and an enlarged head portion of said mounting bolt.

5. The invention of claim 3 wherein said means for attaching said second member to said first member further includes an aperture formed on said leg portion of said second member and roller bearing means rotatably supported on said leg portion of said first member, said roller bearing means cooperating with said aperture means for guiding the movement of said second member with respect to said first member.

6. The invention of claim 3 further including elastomeric washer means disposed about said mounting bolt between said foot portion of said first member and said foot portion of said second member.

7. The invention of claim 1 further including means for adjusting the amount of movement of said second member with respect to said first member.

8. The invention of claim 7 wherein said adjusting means includes a threaded bolt extending through an aperture formed in said foot portion of said first member into threaded engagement with said foot portion of said second member and a cooperating threaded nut disposed about said threaded bolt above said foot portion of said first member, whereby said nut is drawn into engagement with said foot portion of said first member when said second member is moved toward said second position.

9. The invention of claim 1 wherein said locking mechanism means includes roller arm means attached to said second member and pivotally secured to the car door section for moving said locking mechanism means with the car door section.

10. The invention of claim 1 further including guide roller means rotatably secured to said first member, said guide rolller means cooperating with a door track attached to the elevator car for guiding said locking mechanism means as it is moved with the car door section.

11. In an elevator system including an elevator car having a car door section movable between an opened position and a closed position and means for moving the elevator car in an elevator shaft having at least one floor landing with a floor landing door section cooperatively movable with the car door section when the elevator car is located adjacent the floor landing, a means for preventing the car door section from being opened when the elevator car is not located adjacent the floor landing comprising:

locking mechanism means connected to and movable with the car door section, said locking mechanism means including a first locking member, a second locking member, and means for attaching said second locking member to said first locking member for limited movement of said second locking member between a first position and a second position;

means for urging said second locking member toward said first position;

first stop means attached to and movable with said second locking member;

second stop means attached to the car for selectively engaging said first stop means;

interlock roller means secured to the floor landing door section; and clutch vane means secured to the car door section for cooperating with said interlock roller means to move said second locking member to said second position when the elevator car is located adjacent the floor landing, whereby said first stop means engages said second stop means to prevent the car door section from being opened only when said second member is in said first position.

12. The invention of claim 11 wherein said first and second locking members are inverted L-shaped in cross section, each of said first and second locking members having an upper foot portion and a depending leg portion.

13. The invention of claim 11 further including means for adjusting the amount of movement of said second locking member with respect to said first locking member.

14. The invention of claim 13 wherein said adjusting means includes a bolt extending through an aperture formed in said foot portion of said first locking member into threaded engagement with said foot portion of said second locking member and a cooperating nut threaded on said bolt above said foot portion of said first locking member, whereby said nut is drawn into engagement with said foot portion of said first locking member when said second locking member is moved toward said second position.

15. The invention of claim 11 wherein said locking mechanism means includes roller arm means attached to said second locking member and pivotally secured to the car door section for moving said locking mechanism means with the car door section.

16. The invention of claim 15 further including guide roller means rotatably secured to said first locking member, said guide roller means cooperating with a door track on the elevator car for guiding said locking mechanism means as it is moved with the car door section.

17. The invention of claim 16 wherein said clutch vane means includes a clutch arm means pivotally connected to said roller arm means for moving said second locking member toward said second position when the elevator car is located adjacent the floor landing.

18. The invention of claim 17 wherein said clutch vane means includes upper and lower pivot arms pivotally secured to the car door section and a pair of clutch vanes, each pivotally secured at opposite ends to respective ends of said pivot arms, whereby said clutch arms are movable toward and away from each other for cooperating with said interlock roller means.

19. The invention of claim 18 wherein said door track includes a beveled end portion, whereby said guide roller and said locking mechanism means roll downwardly onto said beveled end portion when the car door section is in the closed position to move said clutch vanes to a position of maximum separation therebetween and whereby said guide roller and said locking mechanism means roll upwardly off of said beveled end portion when the car door section is moved toward said opened position to move said clutch vanes toward a position of minimum separation, said locking mechanism means being maintained in said first position when said clutch vanes are at said position of minimum separation.

20. The invention of claim 19 wherein said interlock roller means includes at least one interlock roller secured to the floor landing door section, whereby said interlock roller is disposed between said clutch vanes when the elevator car is located adjacent the floor landing to maintain said clutch vanes at a position of intermediate separation between said positions of maximum and minimum separation, said locking mechanism means being moved to said second position when said clutch vanes are at said position of intermediate separation.

21. In an elevator system including an elevator car having a car door section movable between an opened position and a closed position, an electric motor means for moving the car door ection, an elevator shaft having a plurality of floor landings, each floor landing having a floor landing door section cooperatively movable with the car door section when the elevator car is located adjacent the floor landing, a means for preventing the car door section from being opened when the elevator car is not located adjacent a floor landing comprising:

locking mechanism means connected to and movable with the car door section, said locking mechanism means including a first member, a second member, and means for attaching said second member to said first member for limited movement with respect thereto between a first position and a second position;

means for urging said second member toward said first position;

first stop means attached to and movable with said second member;

second stop means fixed in position on the car for selectively engaging said first stop means;

switch means connected in an electrical circuit to selectively disable the electric motor means;

cam arm means attachjed to and movable with said second member for selectively actuating said switch means; and means for moving said second member to said second position when the elevator car is located at an authorized landing zone in the elevator shaft, whereby said cam arm means actuates said switch means and said first stop means engages said second stop means to prevent the car door section from being opened only when said second member is in said first position.

* * * * *